US012716032B2

(12) United States Patent
Hein et al.

(10) Patent No.: US 12,716,032 B2
(45) Date of Patent: Aug. 25, 2026

(54) BIOSOURCED HYDROCARBON FLUIDS

(71) Applicant: TOTALENERGIES ONETECH, Courbevoie (FR)

(72) Inventors: Christophe Hein, Courbevoie (FR); Benjamin Swoboda, Courbevoie (FR)

(73) Assignee: TOTALENERGIES ONETECH, Courbevoie (FR)

( * ) Notice: Subject to any disclaimer, the term of this patent is extended or adjusted under 35 U.S.C. 154(b) by 195 days.

(21) Appl. No.: 18/569,485

(22) PCT Filed: Jun. 16, 2022

(86) PCT No.: PCT/EP2022/066516
§ 371 (c)(1),
(2) Date: Dec. 12, 2023

(87) PCT Pub. No.: WO2022/263609
PCT Pub. Date: Dec. 22, 2022

(65) Prior Publication Data

US 2024/0279556 A1 Aug. 22, 2024

(30) Foreign Application Priority Data

Jun. 17, 2021 (FR) ..... 2106461

(51) Int. Cl.
*C10G 3/00* (2006.01)

(52) U.S. Cl.
CPC ..... *C10G 3/50* (2013.01); *C10G 3/42* (2013.01); *C10G 2300/1014* (2013.01); *C10G 2400/30* (2013.01)

(58) Field of Classification Search
CPC ..... C10G 3/50; C10G 2300/1014; C10G 2300/1018; C10G 2400/18
See application file for complete search history.

(56) References Cited

U.S. PATENT DOCUMENTS

2018/0148653 A1* 5/2018 Germanaud ..... C10G 2/30

FOREIGN PATENT DOCUMENTS

| | | | |
|---|---|---|---|
| EP | 3143981 | A1 | 3/2017 |
| EP | 3360947 | A1 | 8/2018 |
| WO | 2016185047 | A1 | 11/2016 |
| WO | 2022/263609 | A1 | 12/2022 |

OTHER PUBLICATIONS

ISR-WO dated Oct. 5, 2022 for parent application PCT/EP2022/066516.

* cited by examiner

*Primary Examiner* — Randy Boyer
(74) *Attorney, Agent, or Firm* — DUANE MORRIS LLP; Gregory M. Lefkowitz; Brandon A. Chan

(57) ABSTRACT

The invention concerns a hydrocarbon fluid comprising 75 to 95% by weight of isoparaffins and less than 500 ppm by weight of aromatics relative to the total weight of the hydrocarbon fluid, said fluid having an initial boiling point and a final boiling point in the range of 120 to 240° C. and a flash point lower than 90° C. The invention also concerns the use of the hydrocarbon fluid of the invention as solvent, for example in a paint, material coating, material treatment, sealant, polymerization, aerosol, cleaning or water treatment composition.

19 Claims, No Drawings

BIOSOURCED HYDROCARBON FLUIDS

TECHNICAL FIELD OF THE INVENTION

The invention concerns a biosourced isoparaffinic fluid having properties of particular interest, for example in applications as solvent.

PRIOR ART

Special fluids are liquids used as industrial fluids, agricultural fluids, and fluids for home use generally obtained from fossil hydrocarbons converted by refining methods, but also from numerous products resulting from the polymerization or oligomerization of olefins having 3 to 4 carbons, and also from synthetic hydrocarbons resulting from the conversion of natural gas or synthetic gas derived from biomass and/or coal. These fluids include drilling fluids, lubricants for industry, fluids for formulations intended for automotive vehicles, plant protection products, base fluids for ink formulations, fuels for domestic applications, extender oils for sealants, viscosity-lowering agents for resin-based formulations, pharmaceutical compositions and food contact compositions, fluids intended for cosmetic formulations, heat exchange fluids, dielectric fluids, base lubricant fluids, degreasing fluids.

Industrialists are increasing seeking to replace products of fossil origin by biosourced products (which are not of fossil origin)

Document WO2016185047 describes a heavy hydrocarbon fluid having more than 95% by weight of isoparaffins and less than 100 ppm of aromatics, obtained from a biomass.

It is the objective of the present invention to provide biosourced volatile hydrocarbon fluids having properties adapted to targeted applications

SUMMARY OF THE INVENTION

The invention concerns a hydrocarbon fluid comprising 75 to 95% by weight of isoparaffins and less than 500 ppm of aromatics relative to the total weight of the hydrocarbon fluid, said fluid having an initial boiling point and a final boiling point in the range of 120 to 240° C. and a flash point lower 90° C.

In one embodiment, the difference between the final boiling point and the initial boiling point ranges from 10 to 60° C., preferably from 25 to 45° C.

In one preferred embodiment, the fluid of the invention comprises:

- a weight content of isoparaffins ranging from 80 to 93%, preferably from 85 to 90%, relative to the total weight of the hydrocarbon fluid; and/or
- a weight content of n-paraffins ranging from 5 to 25% by weight, preferably from 7 to 20%, relative to the total weight of the hydrocarbon fluid; and/or
- a weight content of aromatic compounds lower than or equal to 300 ppm, 200 ppm, preferably lower than or equal to 100 ppm, relative to the total weight of the hydrocarbon fluid; and/or
- a weight content of naphthenic compounds lower than or equal to 1%, preferably lower than or equal to 0.5% and more preferably lower than or equal to 100 ppm relative to the total weight of the hydrocarbon fluid.

In one preferred embodiment, the hydrocarbon fluid of the invention has 28 day-biodegradability measured according to the OECD 306 standard higher than or equal to 60%.

In one preferred embodiment, the hydrocarbon fluid of the invention has a flash point lower than or equal to 80° C., preferably lower than or equal to 70° C., more preferably lower than or equal to 60° C.

In one preferred embodiment, the hydrocarbon fluid of the invention, relative to the total weight of the hydrocarbon fluid, comprises:

- from 90 to 98% by weight of paraffins having 9 to 10 carbon atoms, or
- from 90 to 98% by weight of paraffins having 11 to 13 carbon atoms.

The invention also concerns a method for preparing a hydrocarbon fluid of the invention, comprising at least one catalytic hydrogenation step at a temperature of 80 to 180° C. and pressure of 50 to 160 bar, of a deoxygenated and isomerized feedstock of biological origin having a boiling range of 120 to 340° C., preferably of 150 to 340° C.

In one embodiment, the method further comprises a fractionation step after the hydrogenation step.

In one preferred embodiment, the deoxygenated and isomerized feedstock of biological origin has an initial boiling point ranging from 120 to 200° C., preferably ranging from 140 to 170° C.

In one embodiment, the deoxygenated and isomerized feedstock (before hydrogenation) has a flash point ranging from 40 to 90° C., preferably from 50 to 80° C., more preferably of 55 to 70° C.

In one embodiment, the deoxygenated and isomerized feedstock (before hydrogenation) has a pour point lower than or equal to 5° C., preferably lower than or equal to 0° C., more preferably lower than or equal to −5° C., even lower than or equal to −10° C.

The invention also concerns the use of a hydrocarbon fluid of the invention as solvent, for example in a paint, material coating, material treatment, sealant, polymerization, aerosol, cleaning, or water treatment composition.

The invention allows the providing of a biosourced volatile isoparaffinic fluid.

The invention allows the providing of a volatile isoparaffinic fluid having a low flash point, particularly useful for applications as solvent.

DETAILED DESCRIPTION OF THE INVENTION

The invention concerns a hydrocarbon fluid comprising 75 to 95% by weight of isoparaffins and less than 500 ppm by weight of aromatics relative to the total weight of the hydrocarbon fluid, said fluid having an initial boiling point and a final boiling point in the range of 120 to 240° C. and a flash point lower than 90° C.

As a preliminary, it is to be noted that in the description and following claims, the expression «of between» is to be construed as including the cited limits.

In the meaning of the present invention, the word «paraffins» includes isoparaffins and n-paraffins.

In the meaning of the present invention, the word «isoparaffins» designates non-cyclic branched alkanes.

In the meaning of the present invention, the word «n-paraffins» designates non-cyclic linear alkanes.

In the meaning of the present invention, the word «naphthenes» designates cyclic (non-aromatic) alkanes.

The hydrocarbon fluid of the invention comprises from 75 to 95% by weight of isoparaffins, preferably from 80 to 93% by weight of isoparaffins, more preferably from 85 to 90% by weight of isoparaffins, relative to the total weight of the hydrocarbon fluid.

The hydrocarbon fluid of the invention preferably comprises from 5 to 25% by weight of n-paraffins, preferably from 7 to 20%, more preferably from 10 to 15% by weight of n-paraffins, relative to the total weight of the hydrocarbon fluid.

The hydrocarbon fluid of the invention has a weight content of aromatic compounds lower than 500 ppm by weight, preferably a weight content of aromatic compounds lower than or equal to 300 ppm, preferably lower than or equal to 200 ppm, preferably lower than or equal to 100 ppm, preferably lower than or equal to 50 ppm, preferably lower than or equal to 20 ppm.

The hydrocarbon fluid of the invention preferably has a weight content of naphthenic compounds lower than or equal to 1%, preferably lower than or equal to 0.5% and more preferably lower than or equal to 500 ppm relative to the total weight of the hydrocarbon fluid.

In one particularly advantageous embodiment, the hydrocarbon fluid of the invention comprises from 85 to 89% by weight of isoparaffins, from 11 to 15% by weight of n-paraffins, and less than 0.5% by weight of naphthenic compounds, relative to the total weight of the hydrocarbon fluid.

In one particularly advantageous embodiment, the hydrocarbon fluid of the invention comprises from 85 to 89% by weight of isoparaffins, from 11 to 15% by weight of n-paraffins, less than 0.5% by weight of naphthenic compounds and less than 500 ppm by weight of aromatic compounds, relative to the total weight of the hydrocarbon fluid.

In one particularly advantageous embodiment, the hydrocarbon fluid of the invention comprises from 85 to 89% by weight of isoparaffins, from 11 to 15% by weight of n-paraffins, less than 0.5% by weight of naphthenic compounds and less than 100 ppm by weight of aromatic compounds, relative to the total weight of the hydrocarbon fluid.

The contents of isoparaffins, n-paraffins and naphthenes can be measured with methods well known to those skilled in the art, for example by gas phase chromatography. The content of aromatics can be determined by UV spectrometry for example.

The hydrocarbon fluid of the invention has an initial boiling point and a final boiling point in the range of 120 to 240° C., preferably of 125 to 210° C., more preferably of 130 to 210° C.

The boiling range can be determined according to standard ASTM D86.

Preferably, the difference between the final boiling point and the initial boiling point ranges from 10 to 60° C., preferably from 25 to 45° C.

In one embodiment, the hydrocarbon fluid of the invention comprises from 90 to 98% by weight of paraffins having 9 to 13 carbon atoms.

In particularly preferred manner, the hydrocarbon fluid comprises:

- from 90 to 98% by weight of paraffins having 9 to 10 carbon atoms, or
- from 90 to 98% by weight of paraffins having 11 to 13 carbon atoms, relative to the total weight of the hydrocarbon fluid.

The hydrocarbon fluid of the invention has a flash point lower than 90° C., preferably a flash point lower than or equal to 80° C., preferably a flash point lower than or equal to 70° C., more preferably a flash point lower than or equal to 60° C.

The flash point is measured for example in accordance with standard ASTM D93.

In one embodiment, the hydrocarbon fluid of the invention has a viscosity at 40° C. lower than or equal to 2 $mm^2/s$, preferably lower than or equal to 1.7 $mm^2/s$, more preferably lower than or equal to 1.5 $mm^2/s$, further preferably lower than or equal to 1.2 $mm^2/s$, even lower than or equal to 1 $mm^2/s$.

The kinematic viscosity at 40° C. can be measured according to standard ASTM D445.

In one embodiment, the hydrocarbon fluid of the invention comprises from 85 to 89% by weight of isoparaffins, from 11 to 15% by weight of n-paraffins, less than 0.5% by weight of naphthenic compounds and less than 500 ppm by weight of aromatic compounds, relative to the total weight of the hydrocarbon fluid, and has a flash point lower than or equal to 70° C.

In one embodiment, the hydrocarbon fluid of the invention comprises from 85 to 89% by weight of isoparaffins, from 11 to 15% by weight of n-paraffins, less than 0.5% by weight of naphthenic compounds and less than 100 ppm by weight of aromatic compounds, relative to the total weight of hydrocarbon fluid, and has a flash point lower than or equal to 70° C.

In one embodiment, the hydrocarbon fluid of the invention comprises from 85 to 89% by weight of isoparaffins, from 11 to 15% by weight of n-paraffins, less than 0.5% by weight of naphthenic compounds and less than 500 ppm by weight of aromatic compounds relative to the total weight of hydrocarbon fluid, and has a viscosity at 40° C. lower than or equal to 1.7 $mm^2/s$.

In one embodiment, the hydrocarbon fluid of the invention comprises from 85 to 89% by weight of isoparaffins, from 11 to 15% by weight of n-paraffins, less than 0.5% by weight of naphthenic compounds and less than 100 ppm by weight of aromatic compounds, relative to the total weight of the hydrocarbon fluid, and has a viscosity at 40° C. lower than or equal to 1.7 $mm^2/s$.

In one embodiment, the hydrocarbon fluid of the invention comprises:

- from 90 to 98% by weight of paraffins having 9 to 10 carbon atoms, and a viscosity at 40° C. lower than or equal to 1 $mm^2/s$; or
- from 90 à 98% by weight of paraffins having 11 to 13 carbon atoms, and a viscosity at 40° C. lower than or equal to 1.2 $mm^2/s$.

In one embodiment, the hydrocarbon fluid of the invention comprises:

- from 90 to 98% by weight of paraffins having 9 to 10 carbon atoms, having a flash point ranging from 25 to 50° C. and a viscosity at 40° C. lower than or equal to 1 $mm^2/s$; or
- from 90 to 98% by weight of paraffins having 11 to 13 carbon atoms, having a flash point ranging from 50 to 65° C. and a viscosity at 40° C. lower than or equal to 1.2 $mm^2/s$.

The hydrocarbon fluid of the invention also preferably has an extremely low weight content of sulfur compounds, typically less than or equal to 5 ppm, preferably less than or equal to 3 ppm and more preferably less than or equal to 0.5 ppm, i.e. a level too low for detection by conventional analyzers of low sulfur content.

In one particular embodiment, the hydrocarbon fluid of the invention has a 28-day biodegradability of at least 60%, preferably at least 70%, more preferably at least 75% and most preferably of at least 80% measured according to standard OECD 306.

In one embodiment, the hydrocarbon fluid of the invention has a 28-day biodegradability of at least 60%, measured according to the OECD 306 method, and a flash point lower than or equal to 60° C.

In one embodiment, the hydrocarbon fluid of the invention has a 28-day biodegradability of at least 60%, measured according to the OECD 306 method, and a flash point lower than 90° C. and comprises from 85 to 89% by weight of isoparaffins relative to the total weight of the hydrocarbon fluid.

In one embodiment, the hydrocarbon fluid of the invention has a 28-day biodegradability of at least 60% measured according to the OECD 306 method, and a flash point lower than 90° C. and comprises from 85 to 89% by weight of isoparaffins and less than 100 ppm by weight of aromatic compounds relative to the total weight of the hydrocarbon fluid.

In one embodiment, the hydrocarbon fluid of the invention has a 28-day biodegradability of at least 60%, measured according to the OECD 306 method, and a flash point lower than 90° C. and comprises from 85 to 89% by weight of isoparaffins relative to the total weight of the hydrocarbon fluid, and said fluid has an initial boiling point and a final boiling point in the range of 120° C. to 240° C.

In one embodiment, the hydrocarbon fluid of the invention has a 28-day biodegradability of at least 60%, measured according to the OECD 306 method, and a flash point lower than or equal to 65° C. and comprises from 85 to 89% by weight of isoparaffins relative to the total weight of the hydrocarbon fluid, and said fluid has an initial boiling point and a final boiling point in the range of 125° C. to 210° C.

In one embodiment, the hydrocarbon fluid of the invention has a 28-day biodegradability of at least 60%, measured according to the OECD 306 method, a flash point lower than or equal to 65° C. and comprises from 85 to 89% by weight of isoparaffins and less than 100 ppm by weight of aromatic compounds relative to the total weight of the hydrocarbon fluid and said fluid has an initial boiling point and a final boiling point in the range of 125° C. to 210° C.

In one embodiment, the hydrocarbon fluid of the invention has a 28-day biodegradability of at least 60%, measured according to the OECD 306 method, a flash point lower than or equal to 60° C. and comprises from 80 to 90% by weight of isoparaffins relative to the total weight of the hydrocarbon fluid, and said fluid has an initial boiling and a final boiling point in the range of 125° C. to 210° C.

In one embodiment, the hydrocarbon fluid of the invention has a 28-day biodegradability of at least 60%, measured according to the OECD 306 method, a flash point lower than or equal to 50° C. and comprises from 80 to 90% by weight of isoparaffins relative to the total weight of the hydrocarbon fluid, and said fluid has an initial boiling point and a final boiling point in the range of 130° C. to 190° C.

In one embodiment, the hydrocarbon fluid of the invention has a pour point lower than or equal to −20° C., preferably lower than or equal to −40° C., more preferably lower than or equal to −50° C., further preferably lower than or equal to −70° C., or even lower than or equal to −80° C.

The pour point can be measured according to the ASTM D5950 standard test method.

In one embodiment, the hydrocarbon fluid of the invention has a flash point lower than 90° C., a pour point lower than or equal to −50° C. and comprises from 80 to 89% by weight of isoparaffins and from 11 to 15% by weight of n-paraffins, relative to the total weight of the hydrocarbon fluid.

In one embodiment, the hydrocarbon fluid of the invention has a flash point lower than or equal to 65° C., a pour point lower than or equal to −70° C. and comprises from 80 to 89% by weight of isoparaffins and from 11 to 15% by weight of n-paraffins, relative to the total weight of the hydrocarbon fluid In one embodiment, the hydrocarbon fluid of the invention has a flash point lower than or equal to 65° C., a pour point lower than or equal to −70° C. and comprises from 80 to 89% by weight of isoparaffins, from 11 to 15% by weight of n-paraffins and less than 100 ppm by weight of aromatic compounds, relative to the total weight of the hydrocarbon fluid.

Method for Obtaining the Hydrocarbon Fluid

The hydrocarbon fluid of the invention is a hydrocarbon fraction typically derived from the conversion of biomass.

By derived from conversion of biomass, it is meant a hydrocarbon fraction produced from raw materials of biological origin. The raw materials of biological origin can be chosen from among vegetable oils, animal fats, fish oils and mixtures thereof.

The invention also concerns a method for preparing a hydrocarbon fluid of the invention, said method comprising at least one catalytic hydrogenation step, at a temperature of 80 to 180° C. and at a pressure of 50 to 160 bar, of a deoxygenated and isomerized feedstock (or fraction) of biological origin having a boiling range of 120 to 340° C., preferably of 150 to 340° C.

In one embodiment, the method comprises a preliminary step to prepare a deoxygenated and isomerized fraction at a hydrodeoxygenation step (HDO) followed by an isomerization step (ISO).

In one embodiment of the invention, the method for preparing a hydrocarbon fluid comprises:

a) a hydrodeoxygenation step of a feedstock (or fraction) of biological origin to obtain a hydrodeoxygenated feedstock (or fraction) of biological origin,
b) a hydroisomerization step of the hydrodeoxygenated biomass, to obtain a deoxygenated and isomerized feedstock (or fraction) of biological origin,
c) optionally, a distillation step of the deoxygenated and isomerized feedstock (or fraction) of biological origin having a boiling range of 120 to 340° C., preferably of 150 to 340° C.,
d) a catalytic hydrogenation step at a temperature of 80 to 180° C. and at a pressure of 50 to 160 bar of the deoxygenated and isomerized feedstock (or fraction) of biological origin resulting from step b) or from step c) if implemented.

Preferably, the feedstock (or fraction) of biological origin is chosen from among vegetable oils, animal fats, fish oils and mixtures thereof. Among vegetable oils able to be used, mention can be made of rapeseed oil, canola oil, tall oil (or tallol), sunflower oil, soybean oil, hemp oil, olive oil, flax oil, mustard oil, palm oil, groundnut oil, castor oil, coconut oil.

The hydrodeoxygenation step (HDO) leads to decomposition of the structures of the biological esters or triglyceride constituents, to removal of oxygenated, phosphorated, and sulfated compounds and to hydrogenation of olefin bonds. The product derived from the hydrodeoxygenation reaction is then isomerized.

Preferably, the deoxygenated and isomerized feedstock of biological origin has an initial boiling point ranging from 120 to 200° C., preferably ranging from 140 to 170° C., before the hydrogenation step.

Advantageously, the fractions of interest are then subjected to hydrotreatment steps followed by distillation to obtain the specifications of the hydrocarbon fluid of the invention.

This HDO/ISO process is implemented on a crude biological feedstock, also called biomass or raw material of biological origin chosen from the group composed of vegetable oils, animal fats, fish oils and mixtures thereof. The suitable raw materials of biological origin are for example chosen from the group composed of rapeseed oil, canola oil, tall oil or tallol, sunflower oil, soybean oil, hemp oil, olive oil, flax oil, mustard oil, palm oil, groundnut oil, castor oil, coconut oil; animal fats such as suet, recycled food fats, raw materials derived from genetic engineering, and biological raw materials produced from microorganisms such as algae and bacteria. Condensation products, esters or other derivatives obtained from crude biological materials can also be used as raw materials.

Preferably, the raw material of biological origin is an ester or triglyceride derivative. This material is first subjected to a hydrodeoxygenation step (HDO) to decompose ester structures or constituent triglycerides and to remove oxygenated, phosphorated, and sulfated compounds concomitantly with hydrogenation of the olefin bonds. This hydrodeoxygenation step (HDO) of the raw material of biological origin is followed by isomerization of the product obtained, leading to branching of the hydrocarbon chain and an improvement in the properties of the paraffin at low temperatures.

At the HDO step, hydrogen and the raw material of biological origin are passed over a catalytic hydrodeoxygenation bed simultaneously, in the same direction or counter-wise direction. At the HDO step, the pressure and temperature are between 20 and 150 bar and between 200 and 500° C. respectively. Known, conventional hydrodeoxygenation catalysts are used at this step. Optionally, the raw material of biological origin can be subjected to pre-hydrogenation under mild conditions to prevent secondary reactions of the double bonds before the HDO step. After the hydrodeoxygenation step, the product resulting from the reaction is subjected to an isomerization step (ISO) at which the hydrogen and the product, and optionally a mixture of n-paraffins, are passed over catalytic isomerization beds simultaneously and in the same or counter-wise direction. At the ISO step, the pressure and temperature are between 20 and 150 bar and between 200 and 500° C. respectively. Known, conventional isomerization catalysts are used at this step.

Additional secondary processes can also be carried out (such as intermediate mixing, trapping, or other like processes).

Various HDO/ISO processes are described in the literature. Application WO2014/033762 describes a method comprising a pre-hydrogenation step, a hydrodeoxygenation step (HDO) and an isomerization step conducted in counter-current direction. Patent application EP1728844 describes a method for producing hydrocarbon compounds from a mixture of compounds of vegetable and animal origin. This method comprises a pretreatment step of the mixture allowing the removal of contaminants for example alkaline metal salts, followed by a hydrodeoxygenation step (HDO) and isomerization step. Patent application EP2084245 describes a method for producing a hydrocarbon mixture which can be used as diesel oil or in a diesel oil composition, by hydrodeoxygenation of a mixture of biological origin containing fatty acid esters optionally in a mixture with free fatty acids, for example vegetable oils such as sunflower oil, rapeseed oil, canola oil, palm oil or tall oil, followed by hydroisomerization on specific catalysts. Patent application EP2368967 describes said method and the product obtained with this method.

Advantageously, the raw material of biological origin contains less than 15 ppm of sulfur, preferably less than 8 ppm, more preferably less than 5 ppm and further preferably less than 1 ppm in accordance with standard EN ISO 20846. Ideally, the feedstock does not contain sulfur as raw material of biosourced origin. The deoxygenated and isomerized feedstock resulting from the HDO/ISO process is then hydrogenated.

The hydrogen used in the hydrogenation unit is typically highly purified hydrogen. By highly purified, it is meant hydrogen having purity of more than 99% for example, even if other grades can also be used.

The hydrogenation step is performed by means of catalysts. Typical hydrogenation catalysts can be either solid or supported and may comprise the following metals: nickel, platinum, palladium, rhenium, rhodium, nickel tungstate, nickel-molybdenum, molybdenum, cobalt-molybdenum. The supports can be silica, alumina, silica-alumina or zeolites.

One preferred catalyst is a nickel-based catalyst on alumina support having a specific surface area varying between 100 and 200 $m^2/g$ of catalyst, or a solid nickel-based catalyst.

The hydrogenation conditions are typically the following:

- Pressure: 50 to 160 bar, preferably 80 to 150 bar and more preferably 90 to 120 bar;
- Temperature: 80 to 180° C., preferably 120 to 160° C. and more preferably 150 to 160° C.;
- Liquid Hourly Space Velocity (LHSV): 0.2 to 5 $hr^{-1}$, preferably 0.4 to 3 $hr^{-1}$ and more preferably 0.5 to 0.8 $hr^{-1}$;
- Hydrogen treatment rate: adapted to the conditions mentioned above and possibly reaching 200 $Nm^3$/tonnes of feedstock to be treated.

The temperature in the reactors is typically between 150 and 160° C. with a pressure of about 100 bar, whilst the Liquid Hourly Space Velocity is about 0.6 $hr^{-1}$ with a treatment rate adapted to the quality of the feedstock to be treated and the parameters of the first hydrogenation reactor.

Hydrogenation can take place in one or more reactors in series. The reactors may comprise one or more catalytic beds. The catalytic beds are generally fixed catalytic beds.

The hydrogenation process preferably comprises two or three reactors, preferably three reactors, and is more preferably conducted in three reactors in series.

The first reactor allows the trapping of sulfur compounds, hydrogenation of essentially all unsaturated compounds and up to about 90% of aromatic compounds. The product resulting from the first reactor contains substantially no sulfur compound. At the second stage i.e. in the second reactor, the hydrogenation of aromatics is continued and up to 99% of the aromatics are thereby hydrogenated.

The third stage in the third reactor is a finishing stage allowing contents of aromatics to be obtained that are lower than or equal to 500 ppm, preferably lower than or equal to 300 ppm, preferably lower than or equal to 100 ppm, more preferably lower than or equal to 50 ppm, and ideally lower than or equal to 20 ppm even for products with high boiling point for example higher than 300° C.

It is possible to use a reactor comprising two or three catalytic beds or more. The catalysts can be used in varying amounts or essentially equal amounts in each reactor; for three reactors, the amounts as a function of weight can be from 0.05-0.5/0.10-0.70/0.25-0.85 for example, preferably 0.07-0.25/0.15-0.35/0.4-0.78 and more preferably 0.10-0.20/0.20-0.32/0.48-0.70.

It is also possible to use one or two hydrogenation reactors instead of three.

It is also possible for the first reactor to be composed of twin reactors operated alternately. This operating mode in particular allows facilitated charging and discharging of catalysts: when the first reactor comprises the catalyst comprises that is first saturated (substantially all the sulfur is trapped on and/or in the catalyst), it must be changed often.

A single reactor can also be used in which two, three or more catalytic beds are installed.

It may be necessary to insert quench boxes in the recycle system or between the reactors to cool the effluents from one reactor to another or from one catalytic bed to another, to control the temperatures and hydrothermal equilibrium of each reaction. In one preferred embodiment, there are no cooling or quenching intermediates.

In one embodiment the product resulting from the process and/or the separated gases are at least partially recycled in the feed system of the hydrogenation reactors. This dilution contributes towards maintaining the exothermicity of the reaction within controlled limits, in particular at the first stage. Recycling additionally allows heat exchange before the reaction and better temperature control.

The effluent from the hydrogenation unit chiefly contains the hydrogenated product and hydrogen. Flash separators are used to separate the effluents into a gas phase, essentially residual hydrogen, and a liquid phase, essentially the hydrogenated hydrocarbon fractions.

The method can be conducted using three flash separators, one at high pressure, one at intermediate pressure and one at low pressure very close to atmospheric pressure.

The gaseous hydrogen that is collected at the top of the flash separators can be recycled back into the feed system of the hydrogenation unit, or into different levels of the hydrogenation unit between the reactors.

In one embodiment, the end product is separated at atmospheric pressure. It is then fed into a vacuum fractionating unit. Preferably, fractionation is performed at a pressure between 10 and 50 mbar, and more preferably at about 30 mbar.

Fractionation can be performed so that it is possible to remove various hydrocarbon fluids simultaneously from the fractionation column, and so that their boiling point is able to be predetermined.

By adapting the feedstock via the initial and final boiling points thereof, the hydrogenation reactors, separators and fractionation unit can therefore be directly connected without the need to use intermediate vessels. This integration of hydrogenation and fractionation allows optimized thermal integration associated with a reduction in the number of items of equipment and energy savings.

The hydrocarbon fluid of the invention is typically derived from the treatment of raw materials of biological origin.

The hydrocarbon fluid of the invention typically has a biomaterial content of at least 90% by weight, relative to the total weight of the carbon atoms. This content is advantageously higher, in particular higher than or equal to 95% by weight relative to the total weight of the carbon atoms, preferably higher than or equal to 98% by weight relative to the total weight of the carbon atoms, and advantageously it is 100% by weight relative to the total weight of the carbon atoms.

Typically, the biomaterial content, also called biobased carbon content, can be determined in accordance with standard ASTM D6866.

In addition to a particularly high content of biomaterial, the hydrocarbon fluid of the invention has particularly good biodegradability. The biodegradation of an organic chemical product refers to reducing the complexity of the chemical compounds via the metabolic activity of micro-organisms. Under aerobic conditions, the microorganisms convert the organic substances to carbon dioxide, water, and biomass. The OECD 306 method is used to evaluate the biodegradability of individual substances in sea water. With this method, the hydrocarbon fluid of the invention has 28-day biodegradability of at least 60%, preferably of at least 70%, more preferably of at least 75% and advantageously of at least 80%.

Use of the Hydrocarbon Fluid:

A further subject of the invention is the use of the hydrocarbon fluid of the invention as solvent, for example in a paint, material coating (e.g. wood), material treatment (e.g. wood), sealant, polymerization, aerosol, cleaning, or water treatment composition.

The hydrocarbon fluids of the invention can be used: as drilling fluids, in hydraulic fractionation, mining operations, water treatment, as industrial solvents, in paint compositions, for decorative coatings, in coating fluids, in the automotive industry, textile industry, for metal extraction, in explosives, in oil dispersants, in formulations for concrete mould release, in adhesives, in printing inks, in metal working fluids, in coating fluids, in rolling oils in particular for aluminum, as cutting fluids, as rolling oils, as electrical discharge machining fluids (EDM), as anti-rust, as industrial lubricants, in sealing products such as sealants or polymers in particular silicone-based, as viscosity depressants in plasticized polyvinyl chloride formulations, in resins, in varnishes, in polymers used in water treatment, for paper or paper pulp production in particular as thickeners, as cleaning and/or degreasing solvents, for suspension polymerization, in the food processing industry, for food quality applications, home care, heat transfer media, shock absorbers, insulating oils, hydraulic oils, gear oils, turbine oils, textile oils and transmission fluids such as automatic transmission fluids or formulations for manual gearboxes, and as solvents in chemical reactions including crystallization, extraction and fermentation, as dielectric fluid or cooling fluid.

Examples

In the remainder of the present description, examples are given to illustrate the invention and are on no account intended to limit the scope thereof.

Table 1 groups together the physicochemical properties of three hydrocarbon fluids of the invention, and of the hydrotreated vegetable oil (HVO) before hydrogenation.

The fluids were prepared by hydrogenating a hydrotreated vegetable oil (HVO). Hydrogenation was performed at a temperature of 150-160° C., pressure of 100 bar and liquid hourly space velocity of 0.6 $h^{-1}$. The catalyst used for hydrogenation was nickel-on-alumina.

Distillation was carried out after the hydrogenation step to recover the fraction of interest (Fluids 1 to 3).

TABLE 1

| Characteristics | Hydrotreated vegetable oil | Fluid 1 | Fluid 2 | Fluid 3 |
|---|---|---|---|---|
| Aromatics (ppm) | 500 | <20 | <20 | <20 |
| Sulfur (ppm) | <1 | <1 | <1 | <1 |

TABLE 1-continued

| Characteristics | Hydrotreated vegetable oil | Fluid 1 | Fluid 2 | Fluid 3 |
|---|---|---|---|---|
| % isoparaffins (w/w) | 77 | 78 | 83 | 81 |
| % n-paraffins (w/w) | 23 | 22 | 17 | 19 |
| % naphthenes (w/w) | 0 | 0 | 0 | 0 |
| C8 (iso) | 0.7 | 5.2 | 0 | 0 |
| C9 (iso) | 2.53 | 24.5 | 0.6 | 0 |
| C10 (iso) | 4.26 | 38.5 | 7.0 | 0 |
| C11 (iso) | 5.34 | 26.6 | 32.1 | 0.7 |
| C12 (iso) | 5.82 | 4.8 | 48.4 | 6.9 |
| C13 (iso) | 5.45 | 0 | 11.8 | 16.2 |
| C14 (iso) | 5.8 | 0 | 0 | 19.8 |
| C15 (iso) | 6.4 | 0 | 0 | 39.9 |
| C16+ (iso) | 63.7 | 0 | 0 | 16.6 |
| Quantity of carbon of biological origin (%) | 100 | 100 | 100 | 100 |
| Initial boiling point (° C.) | 157 | 141 | 178 | 211 |
| Final boiling point (° C.) | 297 | 182 | 208 | 238 |
| OECD Biodegradability (28-day) (%) | >60% | >60% | >60% | >60% |
| Density at 15° C. (kg/m$^3$) | | 0.7347 | 0.7525 | 0.7652 |
| Flash point (° C.) | 61.5 | 28.5 | 63 | 89 |
| Kinematic viscosity at 40° C. (cSt) | | 0.845 | 1.191 | 1.66 |
| Pour point (° C.) | −14 | −90 | −72 | −57 |

The following standards and methods were used to measuring the above properties:

flash point: EN ISO 2719
density at 15° C.: EN ISO 1185
viscosity at 40° C.: EN ISO 3104
boiling point: ASTM D86
biodegradability: OECD 306 method
pour point: ASTM D5950.

The invention claimed is:

1. A hydrocarbon fluid comprising 80 to 90% by weight of isoparaffins, 7 to 20% by weight of n-paraffins, and less than 500 ppm by weight of aromatics relative to the total weight of the hydrocarbon fluid, said hydrocarbon fluid having an initial boiling point and a final boiling point in the range of 120 to 240° C. and a flash point lower than 90° C., said hydrocarbon fluid having a biodegradability measured at 28 days according to standard OECD 306 greater than or equal to 60%, said hydrocarbon fluid having a pour point of less than or equal to −50° C.

2. The hydrocarbon fluid according to claim 1, wherein the difference between the final boiling point and the initial boiling point ranges from 10 to 60° C.

3. The hydrocarbon fluid according to claim 1, comprising:

a weight content of aromatic compounds lower than or equal to 300 ppm relative to the total weight of the hydrocarbon fluid; and/or a weight content of naphthenic compounds lower than or equal to 1% relative to the total weight of the hydrocarbon fluid.

4. The hydrocarbon fluid according to claim 1, having a biodegradability measured at 28 days according to standard OECD 306 higher than or equal to 70%.

5. The hydrocarbon fluid according to claim 1, having a flash point lower than or equal to 80° C.

6. The hydrocarbon fluid according to claim 1, comprising, relative to the total weight of the hydrocarbon fluid:

from 90 to 98% by weight of paraffins having 9 to 10 carbon atoms or from 90 to 98% by weight of paraffins having 11 to 13 carbon atoms.

7. A method for preparing a hydrocarbon fluid according to claim 1, comprising at least one catalytic hydrogenation step at a temperature of 80 to 180° C. and at a pressure of 50 to 160 bar, of a deoxygenated and isomerized feedstock of biological origin having a boiling range of 120 to 340° C.

8. The preparation method according to claim 7, wherein the deoxygenated and isomerized feedstock of biological origin has a boiling range of 150 to 340° C.

9. The preparation method according to claim 7, further comprising, before the hydrogenation step:

a hydrodeoxygenation step of a feedstock (or fraction) of biological origin to obtain a hydrodeoxygenated feedstock (or fraction) of biological origin, a hydroisomerization step of the hydrodeoxygenated biomass, to obtain a deoxygenated and isomerized feedstock (or fraction) of biological origin, optionally, a distillation step of the deoxygenated and isomerized feedstock (or fraction) of biological origin, to obtain a deoxygenated and isomerized feedstock (or fraction) of biological origin having a boiling range of 120 to 340° C.

10. The preparation method according to claim 7, further comprising a fractionation step after the hydrogenation step.

11. The preparation method according to claim 7, wherein the deoxygenated and isomerized feedstock of biological origin, if applicable after the distillation step, has an initial boiling point ranging from 120 to 200° C.

12. The hydrocarbon fluid according to claim 1, wherein the difference between the final boiling point and the initial boiling point ranges from 25 to 45° C.

13. The hydrocarbon fluid according to claim 1, comprising:

a weight content of isoparaffins ranging from 85 to 90%, relative to the total weight of the hydrocarbon fluid; and/or a weight content of n-paraffins ranging from 10 to 15%, relative to the total weight of the hydrocarbon fluid; and/or a weight content of aromatic compounds lower than or equal to 200 ppm, relative to the total weight of the hydrocarbon fluid; and/or a weight content of naphthenic compounds lower than or equal to 0.5% relative to the total weight of the hydrocarbon fluid.

14. The hydrocarbon fluid according to claim 1, comprising;

a weight content of aromatic compounds lower than or equal to 100 ppm, relative to the total weight of the hydrocarbon fluid; and/or a weight content of naphthenic compounds lower than or equal to 100 ppm relative to the total weight of the hydrocarbon fluid.

15. The hydrocarbon fluid according to claim 1, having a flash point lower than or equal to 70° C.

16. The preparation method according to claim 7, further comprising, before the hydrogenation step:

a hydrodeoxygenation step of a feedstock (or fraction) of biological origin to obtain a hydrodeoxygenated feedstock (or fraction) of biological origin, a hydroisomerization step of the hydrodeoxygenated biomass, to obtain a deoxygenated and isomerized feedstock (or fraction) of biological origin, a distillation step of the deoxygenated and isomerized feedstock (or fraction) of biological origin, to obtain a deoxygenated and isomerized feedstock (or fraction) of biological origin having a boiling range of 150 to 340° C.

17. The preparation method according to claim 7, wherein the deoxygenated and isomerized feedstock of biological origin, if applicable after the distillation step, has an initial boiling point ranging from 140 to 170° C.

18. A method for preparing a solvent, the method comprising adding the hydrocarbon fluid according to claim 1 into a composition selected from a paint, material coating, material treatment, sealant, polymerization, aerosol, cleaning or water treatment composition.

19. The hydrocarbon fluid according to claim 1, comprising 85% to 89% by weight of isoparaffins and further comprising 11% to 15% by weight of n-paraffins.

* * * * *